US005294049A

United States Patent [19]

Trunkle et al.

[11] Patent Number: 5,294,049

[45] Date of Patent: Mar. 15, 1994

[54] POWER TEMP VENT DUCT SYSTEM

[75] Inventors: Timothy J. Trunkle, Mt. Pleasant, S.C.; Paul M. Sarazen, Jr.; Dennis A. Beam, Jr., both of Shelby, N.C.

[73] Assignee: Temp-Vent Corporation, Shelby, N.C.

[21] Appl. No.: 20,686

[22] Filed: Feb. 22, 1993

[51] Int. Cl.[5] ..... F24F 13/15

[52] U.S. Cl. ..... 236/49.5; 285/201; 454/351

[58] Field of Search ..... 236/49.5; 454/347, 350, 454/351; 285/162, 201

[56] References Cited

U.S. PATENT DOCUMENTS

| | | |
|---|---|---|
| 302,215 | 7/1884 | Tucker . |
| 1,335,929 | 4/1920 | Allen . |
| 1,358,193 | 11/1920 | Fulton . |
| 1,781,155 | 11/1930 | Anderson . |
| 2,117,529 | 5/1938 | Wile et al. . |
| 2,187,767 | 1/1940 | Akers . |
| 2,216,873 | 10/1940 | Browne . |
| 2,241,108 | 5/1941 | Akers . |
| 2,407,284 | 9/1946 | Kennedy . |
| 2,510,524 | 6/1950 | Schramm . |
| 2,551,965 | 5/1951 | Petersen et al. . |
| 2,814,977 | 12/1957 | Noll . |
| 2,975,975 | 3/1961 | Weber . |
| 3,027,090 | 3/1962 | Zerhan, Jr. . |
| 3,068,776 | 12/1962 | Day . |
| 3,150,584 | 9/1964 | Allander . |
| 3,195,441 | 7/1965 | Hedrick . |
| 3,202,082 | 8/1965 | Viehmann . |
| 3,220,079 | 11/1965 | Aggson . |
| 3,221,632 | 12/1965 | Copp . |
| 3,368,756 | 2/1968 | Edwards . |
| 3,436,016 | 4/1969 | Edwards . |
| 3,528,606 | 9/1970 | Witten . |
| 3,741,102 | 6/1973 | Kaiser . |
| 3,974,754 | 8/1976 | Powlesland et al. . |
| 4,006,672 | 2/1977 | Matsuyoshi et al. . |
| 4,136,822 | 1/1979 | Felter . |
| 4,151,952 | 5/1979 | Edwards . |
| 4,175,480 | 11/1979 | Beam, Jr. et al. . |
| 4,208,010 | 6/1980 | Beam, Jr. et al. . |
| 4,210,279 | 7/1980 | McSwain . |
| 4,231,514 | 11/1980 | McSwain . |
| 4,243,175 | 1/1981 | McSwain . |
| 4,249,460 | 2/1981 | McSwain . |
| 4,274,330 | 6/1981 | Witten et al. . |
| 4,290,554 | 9/1981 | Hensley . |

(List continued on next page.)

FOREIGN PATENT DOCUMENTS

| | | |
|---|---|---|
| 52231 | 7/1910 | Fed. Rep. of Germany . |
| 545591 | 10/1922 | France . |
| 1377998 | 1/1964 | France . |
| 55-121335 | 9/1980 | Japan . |
| 56-53331 | 5/1981 | Japan . |
| 63-127044 | 5/1988 | Japan . |
| 2115922 | 9/1983 | United Kingdom . |

OTHER PUBLICATIONS

The Power Temp-Vent © Suction Model (Model-S) Moisture Reduction for Crawl Space Homes (May 17, 1991).

*Primary Examiner*—William E. Tapolcai
*Attorney, Agent, or Firm*—Dority & Manning

[57] ABSTRACT

An adaptable, temperature-responsive, powered-fan, foundation ventilator apparatus includes a louver housing defining an air passageway, construction for selectively opening and closing the louver housing air passageway depending upon the temperature, a fan housing defining an air passageway communicating with the louver housing, structure for mounting a fan at the rear edge of the fan housing, a fan carried by the fan mounting structure, a fan orifice plate disposed across the air passageway of the fan housing and defining an orifice through the orifice plate, and a fan that includes a fan blade operatively disposed in the orifice of the orifice plate. The apparatus further includes a flexible elongated duct that connects the fan housing to locations which are obstructed from direct flow to the fan housing. The apparatus further includes a flexible adaptor hood which adjustably connects to the fan housing and to the flexible duct and is configured for easy storage in inventory.

9 Claims, 6 Drawing Sheets

U.S. PATENT DOCUMENTS 4,328,927 5/1982 McSwain .
4,417,687 11/1983 Grant .
4,493,456 1/1985 Sarazen, Jr. et al. .
4,587,892 5/1986 Witten et al. .
4,669,371 6/1987 Sarazen, Jr. et al. .
4,676,145 6/1987 Allred .
4,711,160 12/1987 Witten et al. .
4,715,532 12/1987 Sarazen, Jr. et al. .
4,754,696 7/1988 Sarazen et al. .
4,821,628 4/1989 Sarazen, Jr. et al. .
4,829,882 5/1989 Jackson .
4,962,882 10/1990 Sarazen, Jr. et al. .

POWER TEMP VENT DUCT SYSTEM

BACKGROUND OF THE INVENTION

The present invention relates to a system which exhausts air from the foundation of a dwelling or other building structure. More particularly, the present invention relates to a ventilator with an electrically powered fan which expels air from within the building structure to the outside environment.

A number of ventilators with automatic, temperature responsive louvers are known, including U.S. Pat. No. 4,962,882 to *Sarazen, Jr. et al.* A bimetallic element provides a temperature operative mechanism to open and close the shutter elements of many of these vents. A number of ventilators powered by a fan are known, including: Japanese Publication No. 55-121335A to *Nobutou,* Japanese Patent Publication 56-53331A to *Nakamura.* U.K. Patent Application GB 2 115 922A to *Eccles,* Brevet d'Invention No. 545,591 to *Mertz,* and those disclosed in the following U.S. Patents:

| U.S. Pat. No. | Inventive Entity |
|---|---|
| 4,829,882 | Jackson |
| 4,136,822 | Felter |
| 4,006,672 | Matsuyoshi et al |
| 3,974,754 | Powlesland et al |
| 2,510,524 | Schramm |

However, the suction capability of such powered fans diminishes significantly with distance measured from the rear edge of the fan housing. Moreover, there are often locations of the foundation crawl space that are inaccessible to the suction produced by the powered fan of such ventilators. Some of the foregoing patents disclose the use of humidity sensors and temperature sensors to control operation of the fan.

OBJECTS AND SUMMARY OF THE INVENTION

It is a principal object of the present invention to provide a fan-powered foundation ventilator apparatus that is readily adaptable for applying its suction capability to locations of the foundation crawl space that might otherwise be inaccessible to the suction produced by the powered fan of such ventilators.

It is a further principal object of the present invention to provide an adaptor for a fan-powered foundation ventilator apparatus that readily adapts the ventilator to apply its suction capability to locations of the foundation crawl space that might otherwise be inaccessible to the suction produced by the powered fan of such ventilators, wherein the adaptor is easily stored in inventory and can be applied to the ventilator without tools and with only a small amount of manual effort.

It is yet a further principal object of the present invention to provide an adaptor for a fan-powered foundation ventilator apparatus that readily adapts the ventilator to apply its suction capability to locations of the foundation crawl space that might otherwise be inaccessible to the suction produced by the powered fan of such ventilators, wherein the adaptor is easily stored in inventory and can be applied to the ventilator without tools and with only a small amount of manual effort and fits a wide range of ventilator sizes.

It is another principal object of the present invention to provide a fan-powered foundation ventilator apparatus that can localize its suction capability for locations of the foundation crawl space that might otherwise be inaccessible to the suction produced by the powered fan of such ventilators.

It is still another principal object of the present invention to provide a fan-powered foundation ventilator apparatus that can localize its suction capability for locations of the foundation crawl space that might otherwise be inaccessible to the suction produced by the powered fan of such ventilators while providing a self-regulating air passageway controllable according to the temperature and/or humidity of the air disposed in the space beneath the floors and in the vicinity of foundation walls of building structures in which the ventilator apparatus is mounted.

It is yet another principal object of the present invention to provide an improved apparatus for controlling the humidity, quality, and temperature of the air disposed in the space beneath the floors and in the vicinity of foundations of building structures.

It also is a principal object of the present invention to provide an improved foundation ventilator apparatus for controlling the humidity, quality, and temperature of the air disposed in the space beneath the floors and in the vicinity of foundations of building structures.

It is yet a further principal object of the present invention to provide a foundation ventilator apparatus having an air passageway with an opening that is self-regulating for powered exhaust by a fan disposed in the ventilator housing and controllable according to the temperature and/or humidity of the air disposed in the space beneath the floors and in the vicinity of foundation walls of building structures in which the ventilator apparatus is mounted.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, a preferred embodiment of the adaptable, temperature-responsive powered-fan foundation ventilator apparatus of the present invention includes at least one ventilator of a first type. The first ventilator is powered in the sense of having an electrically powered fan and is temperature-responsive in at least the sense of having an automatic means for opening and closing the air passageway of the ventilator depending upon the ambient temperature. A preferred embodiment of the temperature-responsive, powered-fan first ventilator comprises a louver housing, temperature-responsive means for opening and closing the air passageway of the louver housing, a fan housing, a powered fan disposed inside the fan housing, an orifice plate disposed inside the fan housing with its orifice disposed around the fan blade of the fan. A temperature-responsive means for opening and closing the air passageway of the louver housing, can include a bimetallic element.

In further accordance with the present invention, a means is provided for localizing the suction capability of the fan. As embodied herein, the suction localizing means includes an elongated, flexible, axially expandable duct having a first end disposed to be connected in communication with the rear end of the fan housing and having a second end disposed opposite to the first end.

Moreover, the duct desirably is configured with the capability to bend so that the first end can be pointed in a direction that is at least ninety degrees from the direction in which the second end can be pointed.

The invention also includes a means for connecting the suction localizing means and the fan housing. As embodied herein, such connecting means desirably includes an adaptor having a front end connected to the rear end of the fan housing and a rear end of the adaptor disposed opposite to the front end of the adaptor and connected to the first end of the elongated flexible expandable duct.

In further accordance with the present invention, a means is provided so that the front end and rear end of the adaptor are adjustable to fit a range of differently sized and shaped fan housings and ducts, respectively. Examples of such means include fabricating the adaptor from flexible material as well as employing one or more elastic members, various adhesive members such as strips of duct tape, and various similarly configured substrate members with mating hook-and-loop fasteners.

The accompanying drawings, which are incorporated in and constitute a part of this specification, disclose illustrative preferred embodiments of the invention and, together with the description, serve to explain the principles of the invention. The particular details of each of the foregoing named elements of the apparatus of the present invention, including their configurations and interrelationships, are described below and in the drawings, in which like components are identically numbered.

DETAILED DESCRIPTION OF THE PREFERRED EMBODIMENTS

Figure 1:
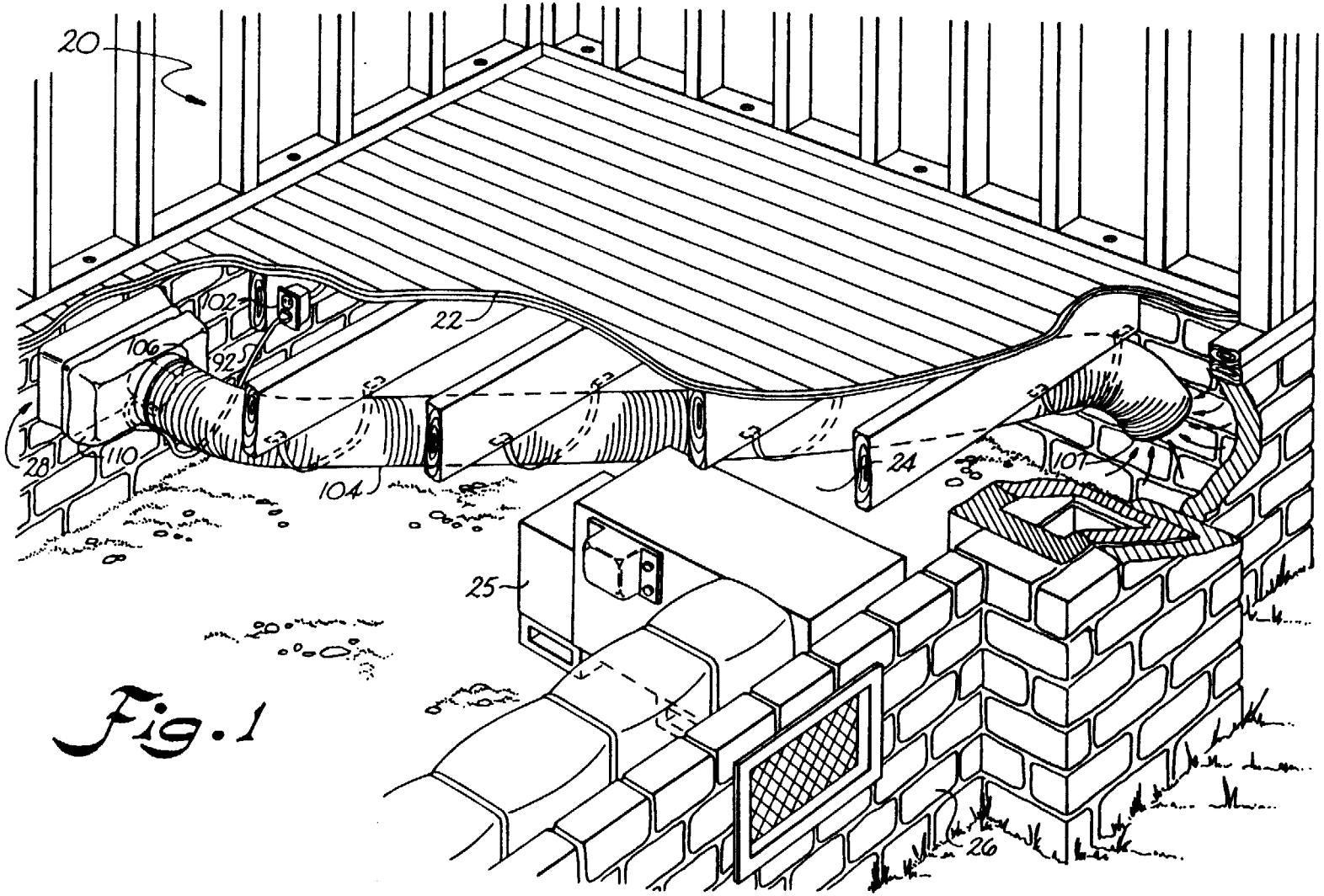
FIG. 1 illustrates an elevated isometric view of a preferred embodiment of the apparatus of the present invention installed within the crawl space of a building and having certain components shown in phantom with dashed lines.

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Repeat use of reference characters throughout the present specification and appended drawings is intended to represent the same or analogous features or elements of the invention.

Figure 6:
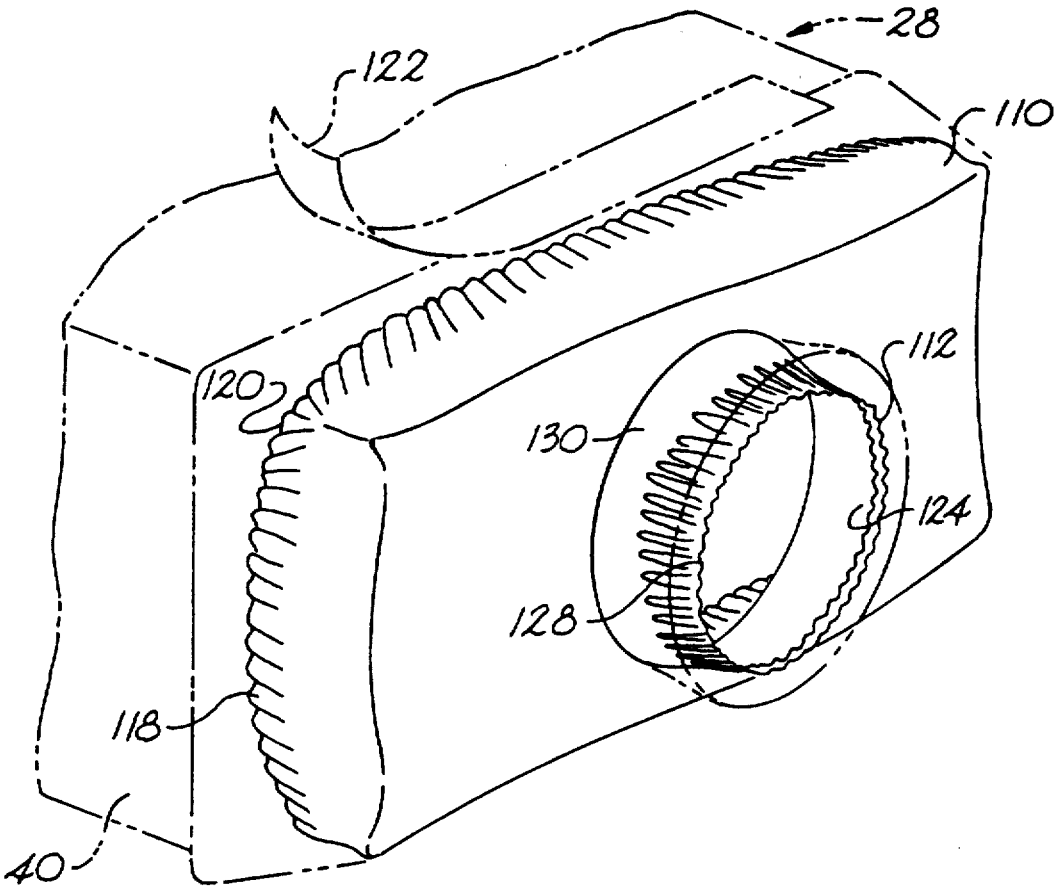
FIG. 6 schematically illustrates an alternative means of attaching a preferred embodiment of the adaptor apparatus of the present invention.
Figure 7:
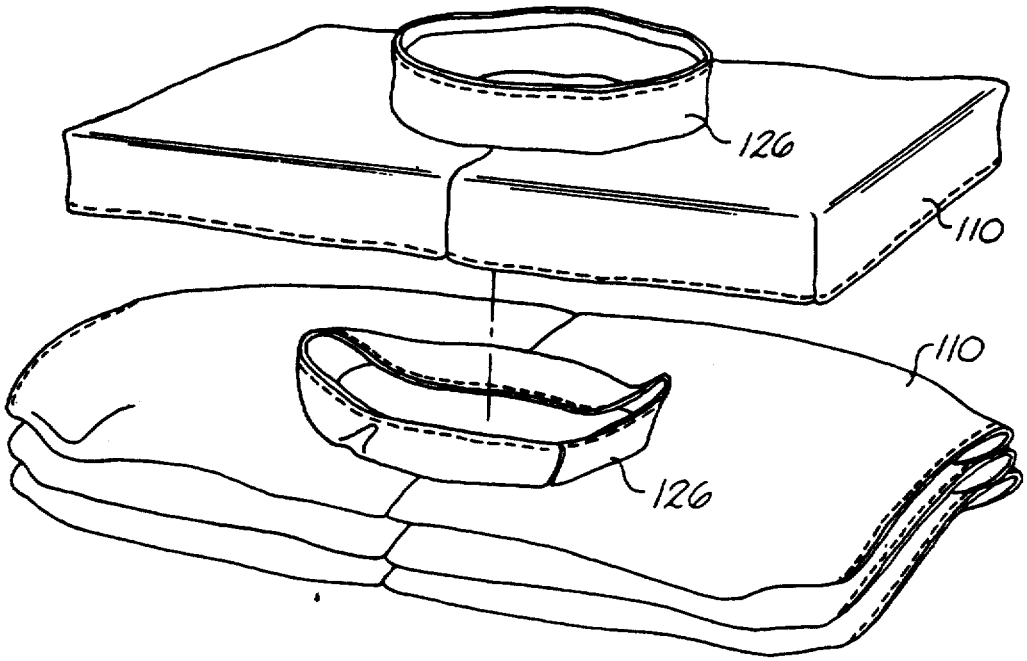
FIG. 7 schematically illustrates a preferred embodiment of the adaptor apparatus of the present invention in a deployed configuration (top figure) and in a stored configuration (bottom figure)
Figure 8:
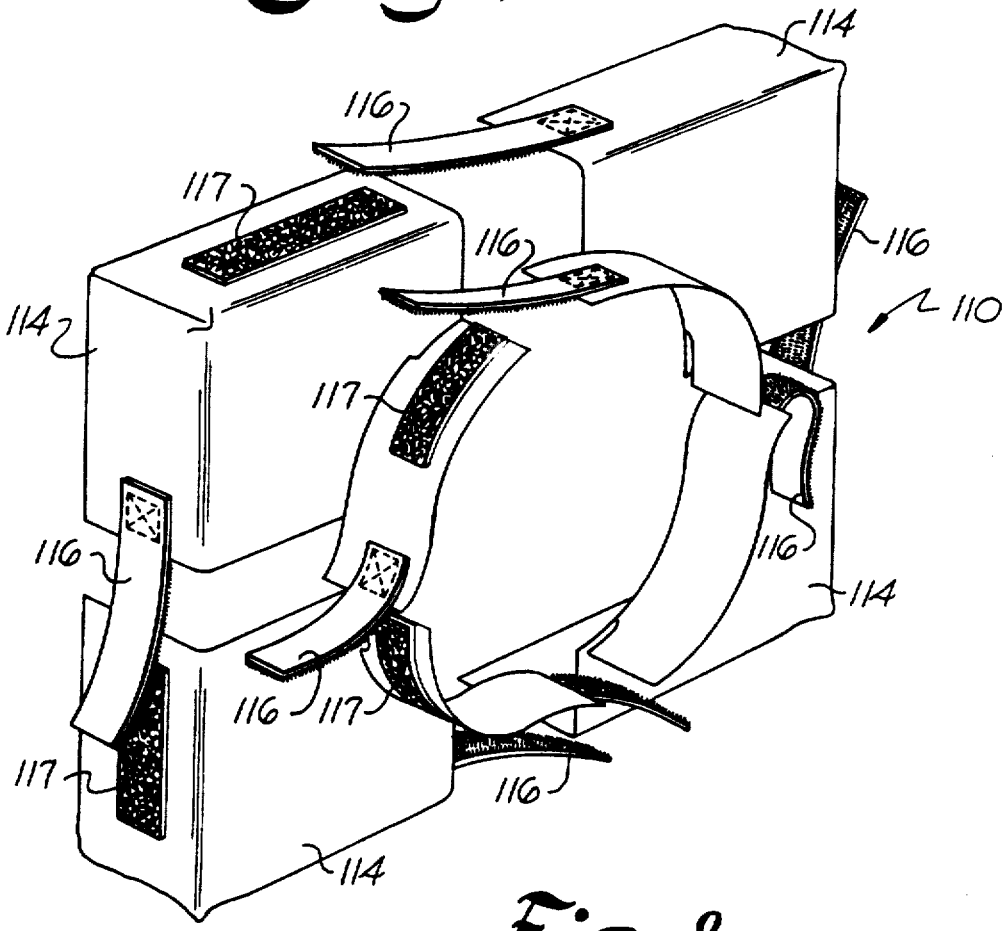
FIG. 8 schematically illustrates another preferred embodiment of the adaptor apparatus of the present invention in a disassembled configuration.

The present invention is directed to an adaptable, temperature-responsive, powered-fan foundation ventilator apparatus, which is usefully employed in the crawl space defined by the foundation walls and floor of a building structure or the cellar of a building structure, to control moisture and prevent the growth of fungus, mold, and the like which may adversely affect the structural integrity of the building. The apparatus also can be employed to change the air beneath the building structure and thereby prevent the build-up of undesirable levels of radon gas or odorous gasses for example. A perspective view of a preferred embodiment of the apparatus is schematically illustrated in FIG. 1 installed in a building structure (generally designated by the numeral 20) beneath the floor 22 and in the crawl space 24 defined by the foundation walls 26 of the building 20. FIGS. 6–8 disclose alternative embodiments of components of an adaptor apparatus of the present invention. As will become apparent, further embodiments of the present invention can be obtained by combining one or more components from each of the disclosed embodiments.

Figure 2:
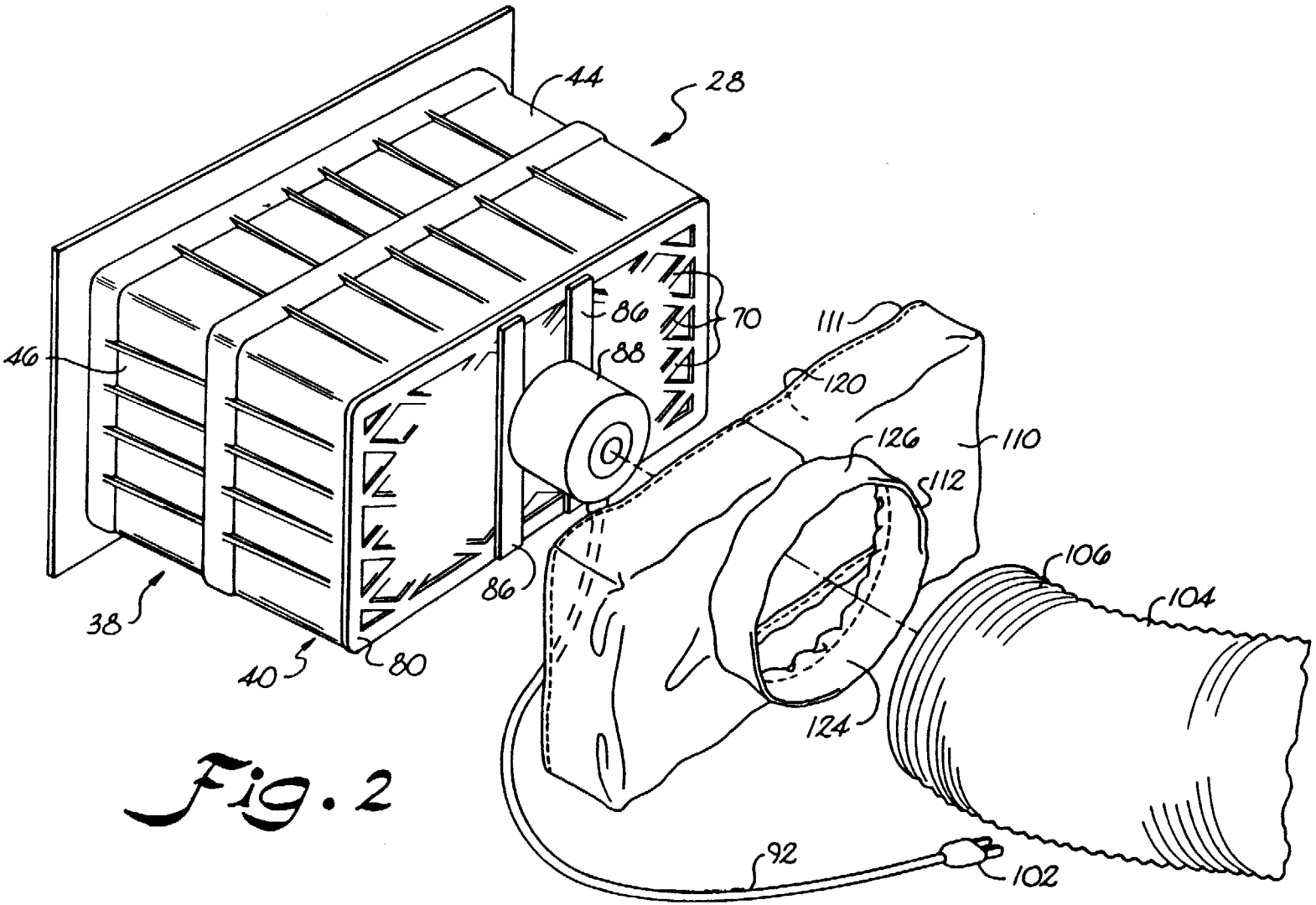
FIG. 2 illustrates an elevated isometric view of a preferred embodiment of the apparatus of the present invention from the rear in a disassembled configuration.
Figure 3:
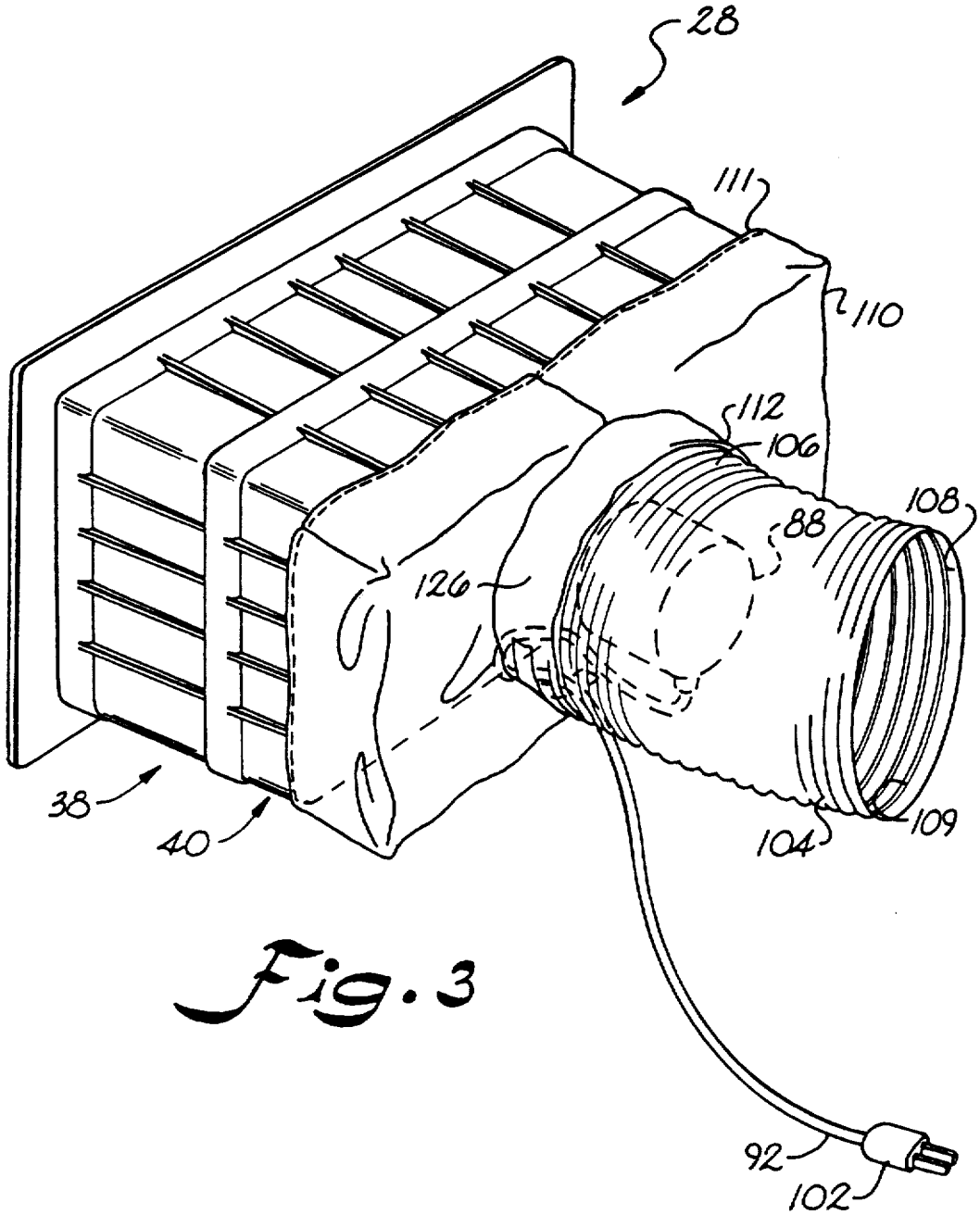
FIG. 3 illustrates an elevated isometric view of a preferred embodiment of the apparatus of the present invention from the rear and in an assembled configuration.
Figure 4:
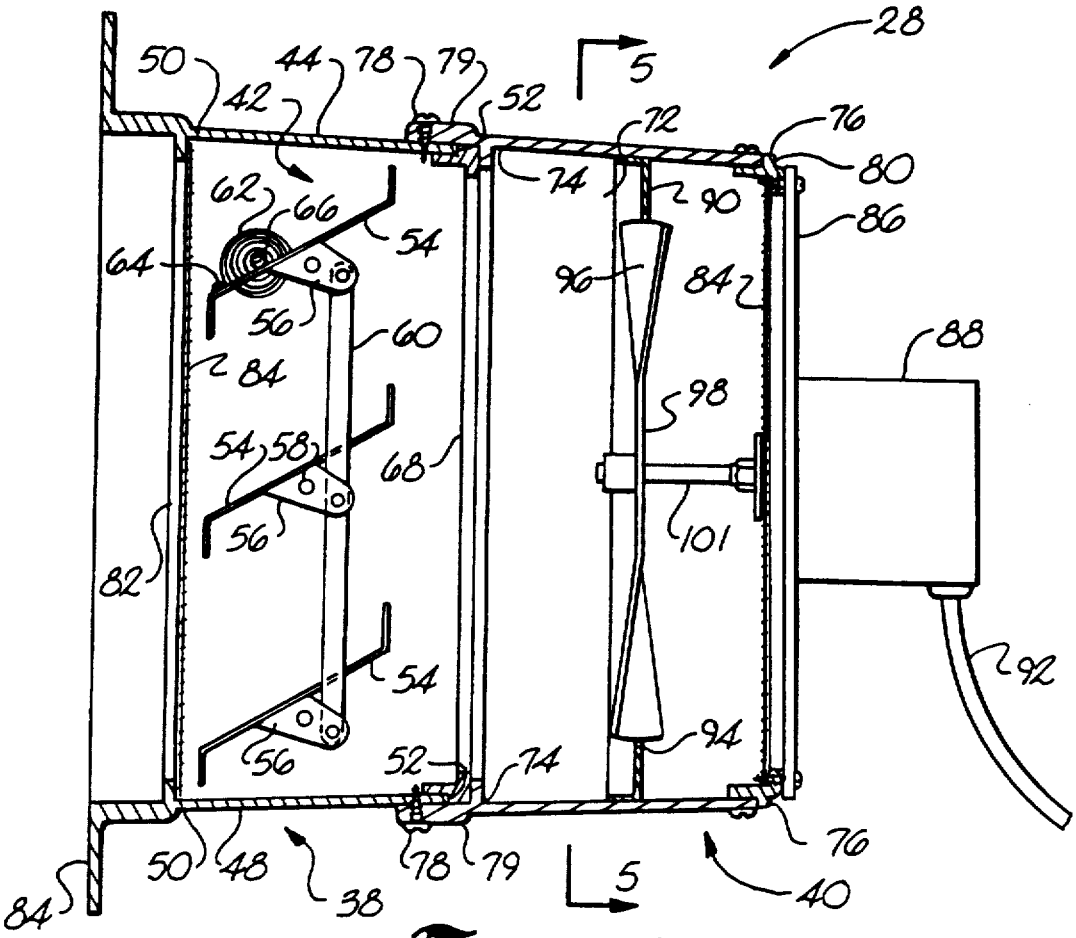
FIG. 4 illustrates a side plan view of the embodiment shown in FIG. 2 taken with the side walls removed to reveal operational components of the embodiment.

In accordance with the present invention, at least one ventilator of a first type is provided. The first ventilator is powered in the sense of having an electrically powered fan and is temperature-responsive in at least the sense of having an automatic means for opening and closing the air passageway of the ventilator depending upon the temperature of the air surrounding the first ventilator. A preferred embodiment of the temperature-responsive, powered-fan, first ventilator of the apparatus of the present invention is shown in FIGS. 1–6 and is represented generally by the numeral 28. As shown in FIGS. 2, 3 and 4 for example, the first ventilator of the present invention comprises two main parts, namely, a louver housing, which is indicated generally by the numeral 38, and a fan housing, which is indicated generally by the numeral 40. Both louver housing 38 and fan housing 40 are preferably manufactured of molded polymeric material.

As embodied herein and shown in FIGS. 2, 3, and 4, the structure and operation of the louver housing of the first ventilator can be the same as the structure and operation of any of a number of temperature-responsive ventilators such as disclosed in the following U.S. Patents, the disclosures of such Patents being hereby incorporated into this patent application by this reference:

| U.S. Pat. No. | Inventive Entity |
|---|---|
| 4,962,882 | Sarazen, Jr. et al |
| 4,754,696 | Sarazen et al |

-continued

| U.S. Pat. No. | Inventive Entity |
|---|---|
| 4,715,532 | Sarazen, Jr. et al |
| 4,669,371 | Sarazen, Jr. et al |
| 4,493,456 | Sarazen, Jr. et al |
| 4,328,927 | McSwain |
| 4,290,554 | Hensley |
| 4,274,330 | Witten et al |
| 4,243,175 | McSwain |
| 4,231,514 | McSwain |
| 4,210,279 | McSwain |
| 4,208,010 | Beam, Jr. et al |
| 4,175,480 | Beam, Jr. et al |
| 4,151,952 | Edwards |
| 3,528,606 | Witten |
| 3,436,016 | Edwards |
| 3,368,756 | Edwards |
| 3,195,441 | Hedrick |
| 3,068,776 | Day |

As embodied herein and shown in one of FIGS. 2 and/or 4 for example, louver housing 38 preferably defines a unitary structure that includes a top 44, a first sidewall 46, a second sidewall disposed opposite first sidewall 46, and a bottom 48 disposed opposite top 44. As shown in FIG. 4 for example, louver housing 38, and accordingly each of top 44, bottom 48, and sidewalls 46, all of which define housing 38, defines a front edge 50 and a rear edge 52 disposed opposite front edge 50.

In accordance with at least the first ventilator of the present invention, means are provided for selectively opening and closing the louver housing air passageway depending upon temperature. This temperature dependent opening and closing means desirably is disposed in the air passageway of the louver housing. As embodied herein and shown in FIG. 4 for example, the temperature dependent opening and closing means desirably includes at least two elongated louvers 54 rotatably disposed across the air passageway 42. Each louver 54 defines a longitudinal axis of rotation which would be in the direction perpendicular to the plane of the paper on which FIG. 4 is depicted. Rotation of each louver 54 about its longitudinal axis functions to open the air passageway 42 to admit air and light through the first ventilator 28 in one position of the louvers 54 and functions to close the air passageway to prevent air and light from passing through the ventilator in a second position of the louvers.

The temperature dependent opening and closing means further includes a means for supporting each of the louvers for rotation about the longitudinal axis of rotation. As embodied herein and shown in FIG. 4 for example, the rotational supporting means can include for each louver 54 a support flange 56 pivotally mounted on a support post 58 connected to the sidewalls 46 of louver housing 38.

The temperature dependent opening and closing means also includes means for linking the louvers for simultaneous rotation about each longitudinal axis of rotation of each of the louvers. As embodied herein and shown in FIG. 4 for example, the linking means desirably includes an elongated drive element 60 pivotally connected to at least one of the louvers 54 and desirably connected pivotally to each of the louvers via respective support flanges 56.

In still further accordance with the present invention, the temperature dependent opening and closing means also includes a means for sensing the temperature in the environment of the first ventilator of the apparatus of the present invention, to provide the temperature sensitive means for opening and closing the ventilator to the passage of air therethrough. As embodied herein and shown in FIG. 4 for example, the temperature sensing means preferably defines a bimetallic coil 62 having an inner free end 66 disposed at the innermost portion of the coil and an outer free end 64 disposed at the outermost circumference of the coil. Bimetallic coil 62 expands and contracts according to the temperature of its environment. The free end 64 outside the bimetallic coil 62 engages the drive element 60 pivotal connection via attachment to at least one of support flanges of louvers 54 for example. The opposite free end 66 disposed inside the coil 62 is desirably anchored to a structure connected to the walls 46 of the passageway of the louver housing 38. In operation, the expansion or contraction of coil 62 is transmitted to the louvers by movement of outer end 64 of coil 62. This movement results because inner end 66 is held fixed to one of the sidewalls 46 defining the air passageway 42 of the louver housing 38. Movements of outer end 64 of coil 62 move drive element 60. Translational movement of drive element 60 by coil 62 results in pivoting movement of louvers 54, which are pivotally mounted to drive element 60 via respective support flanges 56. In so doing, coil 62 provides the necessary force to open and close first ventilator 28 to the passage of air therethrough. Other embodiments of the temperature dependent louver housing opening and closing means are disclosed in the temperature dependent ventilators listed above.

In some embodiments of the first ventilator of the apparatus of the present invention, as shown in FIG. 4 for example, a grill 68 is integrally connected to rear edge 52 of louver housing 38. Preferably, grill 68 is disposed across the air passageway 42 defined by louver housing 38 and defines open spaces through a grid work of members which constitute grill 68, such members being like the ones shown in FIG. 2 and designated by the numeral 70.

In further accordance with the present invention, and as shown in FIG. 4 for example, first ventilator 28 desirably includes a fan housing 40 that also defines an air passageway 72 therethrough. Fan housing 40 desirably defines a front edge 74 and a rear edge 76 opposite to the front edge 74 and disposed on the rear end of fan housing 40. As shown in FIG. 4 for example, the two housings 38, 40 of first ventilator 28 are connected to one another by having the front edge 74 of fan housing 40 disposed in opposition to rear edge 52 of louver housing 38. As shown in FIG. 4 for example, the two housings 38, 40 are attached together as by screws 78 through a connection flange 79 which overlaps rear edge of louver housing 38 and forms an integral forwardly disposed part of fan housing 40.

As shown in FIGS. 2 and 4 for example, a second grill 80 comprising a plurality of members 70 desirably is disposed across the air passageway 72 of fan housing 40 and in the vicinity of the rear edge 76 of fan housing 40. As shown in FIG. 4 for example, a third grill 82 comprising a plurality of members 70 desirably is disposed across the air passageway 42 of louver housing 38 and in the vicinity of the front edge 50 and collar member 84 of louver housing 38. A screen 84 formed of nylon or metal can be disposed against the back side of each of second grill 80 or third grill 82 and respectively connected thereto to provide a finer filtering of air passing through grills 80 or 82. However, preferably no screen is provided across first grill 68 since first grill 68 is not intended to face the exterior environment of the foundation containing the first ventilator 28. Rather, the second and third grills 80, 82 are intended to face the exterior environment of the foundation containing the first ventilator 28. Screen 84 can be attached by heat sealing or applying a suitable adhesive.

Figure 5:
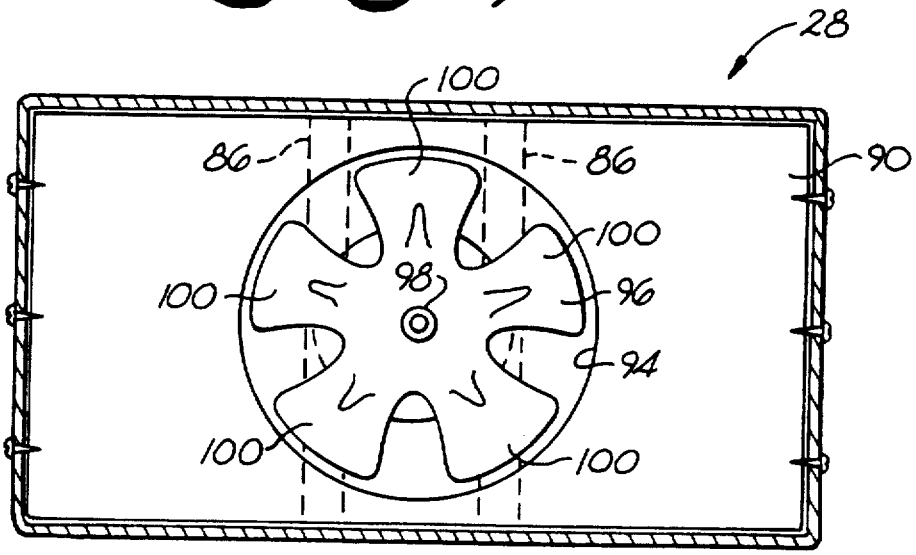
FIG. 5 illustrates a cross-sectional view taken along the lines 5—5 of FIG. 4 and having certain components shown in phantom with dashed lines.

The first ventilator 28 further desirably includes a means for mounting a fan. The fan mounting means desirably is disposed in opposition to the rear edge of the fan housing. As shown in FIGS. 2, 4, and 5 for example, the fan mounting means desirably includes at least one mounting member 86 and desirably two mounting members 86 are provided and connected to the rear edge of fan housing 40 and carry a fan motor 88. A suitable embodiment of fan motor 88 is one rated for 1/100 horsepower at 115 volts AC and drawing 0.5 amps to generate 1,550 rpm's.

The first ventilator 28 further desirably includes a fan orifice plate 90 disposed across the air passageway of the fan housing 40 and between the front and rear edges 74, 76, respectively, of the fan housing. As embodied herein and shown in FIGS. 4 and 5 for example, fan orifice plate 90 desirably defines an orifice 94 through same. As shown in FIGS. 4 and 5 for example, the fan includes a fan blade 96 operatively disposed in orifice 94 of orifice plate 90. The fan blade 96 desirably is a six inch diameter blade that has a clockwise one-quarter inch bore on discharge. The diameter of the orifice 94 is desirably six and one-quarter inches, and the fan blade 96 is centered in the orifice 94 with the plane of the hub portion 98 of the fan blade 96 disposed parallel to the plane of orifice plate 79. A preferred embodiment of the fan blade 96 is a Model L-2018 six-blade 100, six inch diameter, one-quarter inch bore on discharge available from the Swift Company of Wauseon, Ohio 43567. However, a five-blade 100 unit also can be used and is available from Air Drive Company of Libertyville, Ill. and sold under Model BOW-605-37. The fan has a motor 88 having an armature shaft 101 extending toward fan orifice plate 90, and fan blade 96 is attached to armature shaft 101. Desirably, orifice plate 90 is disposed a predetermined distance from first grill 68 of louver housing 38, and this distance preferably is the range of one and three eighths inches to one and five eighths inches with the most desirable separation distance being one and five eighths inches. The latter separation distance provides optimum fan exhaust capability for a six inch diameter fan blade, a rectangularly shaped fan housing air passageway with dimensions of about 6 inches by 15 inches, and a fan orifice plate having a circular shaped orifice 94 of six and one-quarter inches diameter.

The first ventilator also desirably includes means for electrically connecting the fan motor to a power source for powering the fan motor. The electric connecting means desirably is electrically connected to the fan motor. As embodied herein and shown in one or more of FIGS. 1–4 for example, the electric connecting means desirably includes electrically conducting wire within an electric cord 92 and further can include an electrical plug 102.

As shown in FIG. 1, the interposition of one or more walls 26 or other large objects such as a furnace 25, obstructs the direct access of the fan housing 40 from one or more locations in the foundation crawl space 24. Such obstructions to the flow of exhaust air drawn into the fan of the first ventilator 28, can be overcome by providing a means for localizing the suction capability of the ventilator apparatus.

In further accordance with the present invention, a means is provided for localizing the suction capability of the fan of the ventilator apparatus. As shown in FIGS. 1–3 for example, a preferred embodiment of the suction localizing means includes a flexible duct 104 extending from first ventilator 28 to the desired location from which air in the foundation crawl space 24 is to be exchanged to the outside atmosphere. As shown in FIG. 1, duct 104 is configured with the capability to bend so that a first end 106 can be pointed in a direction that is at least ninety degrees from the direction in which a second end 107 can be pointed. For example, as shown in FIG. 3, duct 104 can be fabricated of wide mesh nylon fabric 108 which is impregnated with vinyl and shaped in the form of a tubular sock. The tubular sock provides a continuous open path along its entire length, and the diametric cross-section may be circular or another shape, as desired. In addition, as shown in FIG. 3 for example, duct 104 can include a thin gauge plastic coated metal wire 109, which is configured in a helix and disposed and secured inside the tubular sock forming duct 104. The wire 109 maintains the opening in duct 104 in a condition that continuously allows the passage of air therethrough. The helical configuration of wire 109 combined with the flexibility of the vinyl-impregnated, wide mesh nylon fabric 108, provides a configuration that allows the length of duct 104 to be compressed or elongated in accordion-like fashion and permits the length of duct 104 to be directed such that the first end 106 is disposed to point in a direction that is at least 90° away from the direction in which the second end 107, opposite to the first end 106, can be pointed. This bending of the duct 104 can occur more than once, depending upon the length of the duct 104. Moreover, instead of an accordion-like configuration shown in FIG. 3 for example, an alternative duct embodiment could employ a telescoping configuration in which alternating sections of the duct were configured to become nested within adjacent duct sections with slightly larger cross-sectional diameters. Duct 104 desirably has a diameter of at least 6 inches to take advantage of a fan blade of similar diameter.

In further accordance with the present invention, a means is provided to effect the connection between the duct and the fan housing. As shown in FIGS. 1–3 and 6–8, such connecting means includes an adaptor which is configured in the form of a hood 110. Hood 110 desirably is formed of a vinyl-covered nylon fabric and is configured to fit around the rear end of fan housing 40. Accordingly, in the embodiment shown in FIG. 2, hood 110 is provided with four substantially square-cornered seams which fit around the rectangular-shaped rear end of fan housing 40. While the vinyl-backed hood 110 is formed of material that is substantially impermeable to the passage of air and moisture, the fit between hood 110 and the rear end of fan housing 40 is less than completely air-tight. As shown in FIG. 3 for example, the fit between hood 110 and the rear end of fan housing 40 also permits the electrical cord 92 to protrude from between hood 110 and one side of fan housing 40. Moreover, the fit between hood 110 and the rear end of fan housing 40 permits easy installation and removal of hood 110 to and from the rear end of fan housing 40.

In further accordance with the present invention, a means is provided for selectively attaching the front end of the adaptor to the rear end of the fan housing. As shown in FIGS. 2 and 3, adaptor 110 has a front end 111 connected to a rear edge of fan housing 40 and has a rear end 112 disposed opposite to front end 111 of adaptor 110. In one embodiment of the means for selectively attaching the front end of the adaptor to the rear end of the fan housing shown in FIG. 8 for example, adaptor 110 is divided into four mating and identically configured members 114 that are provided with strategically located substrates 116, 117 of mating hook-and-loop fasteners so that the adaptor can be expanded in two perpendicular directions to accommodate various square and rectangular shapes. In another embodiment of the means for selectively attaching the front end of the adaptor to the rear end of the fan housing shown in FIG. 6 for example, an elastic gathered front end collar 118 is configured to be disposed around the opening 120 intended to be attached to the square-shaped rear end of fan housing 40. The elastic which forms front end gathered collar 118, enables adaptor 110 to conform to fan housing 40 having a rear end of any shape or size. In yet another embodiment of the means for selectively attaching the front end of the adaptor to the rear end of the fan housing shown in dashed line in FIG. 6 for example, duct tape 122 can be used to ensure that the elastic front end collar 118 does not slip from the rear end of fan housing 40.

In still further accordance with the present invention, a means is provided for selectively attaching the rear end of the adaptor to the first end of the duct. As shown in FIG. 2 for example, adaptor 110 has a circular cross-sectional outlet opening 124 at rear end 112. As shown in FIGS. 2 and 3, elongated, flexible, expandable duct 104 has a first end 106 connected to rear end 112 of adaptor 110. A first end 106 of elongated flexible duct 104 is connected as by sewing to a rear end collar 126 which receives a first end 106 of elongated flexible duct 104. Moreover duct 104 need not be circular in cross section. In one embodiment of the means for selectively attaching the rear end of the adaptor to the first end 106 of the duct 104 shown in FIG. 8 for example, adaptor 110 is divided into four mating identically configured members 114 that are provided with strategically located substrates 116, 117 of mating hook-and-loop fasteners so that the adaptor 110 can be expanded in two perpendicular directions to accommodate various square and rectangular shapes of duct 104. FIG. 6 illustrates another embodiment of the means for selectively attaching the rear end of the adaptor to the first end of the duct. As shown in FIG. 6, an elastic gathered rear end collar 128 is configured to be disposed around the opening 124 intended to be attached to the first end 106 of duct 104. The elastic enables rear end gathered collar 128 of adaptor 110 to conform to any shape or size duct 104. In yet another embodiment of the means for selectively attaching the rear end of the adaptor shown in dashed line in FIG. 6 for example, to the first end of the duct, duct tape 130 can be used to ensure that the elastic collar 128 does not slip from the first end 106 of duct 104.

In addition to the use described above in the field of foundation ventilators, flexible adaptor 110 can be used generally in the heating and air conditioning field, where typically there is a problem in connecting a square housing, which empties into a room, on the one hand and a round duct, which carries the air to and from the housing. Thus, whenever a square shape must be connected to a round shape, conventional adaptors are made of a hard material such as metal and therefore are rigid. Because they are rigid, the storage of the different sizes of such rigid adaptors requires large amounts of space. However, as shown in FIG. 7 for example, adaptor 110 of the present invention is flexible enough to be folded and can be stored in a relatively flat condition. Thus, significantly less space is required to maintain inventory of flexible adapter 110 of the present invention than is required to be maintained for rigid adaptors. Moreover, the ability of flexible adaptors 110 of the present invention to conform to various shapes and sizes, further reduces the inventory to be maintained relative to conventional rigid adaptors.

What is claimed is:

1. An adaptable, temperature-responsive, powered-fan foundation ventilator system, comprising:

a fan housing defining an air passageway therethrough, said fan housing defining a front edge and a rear end disposed generally opposite said front edge;

an electric-powdered fan mounted to said fan housing;

a means for localizing the suction capability of said fan;

a means for connecting said suction localizing means and said fan housing, said connecting means including an adaptor having a front end disposed to be connected to said rear end of said fan housing, wherein said front end of said adaptor is formed of flexible material said adaptor having a rear end disposed to be connected to said localizing means;

a louver housing defining an air passageway therethrough, said louver housing defining a front edge and a rear edge opposite said front edge, said rear edge of said louver housing being disposed in opposition to said front edge of said fan housing; and a means for selectively opening and closing said louver housing air passageway depending upon the temperature of the surrounding atmosphere, said temperature dependent opening and closing means being disposed in said air passageway of said louver housing.

2. Apparatus as in claim 1, wherein said suction localizing means includes:

an elongated, flexible, axially expandable duct having a first end disposed to be connected to said rear end of said adaptor and having a second end disposed opposite to said first end, said duct being configured with the capability to bend so that said first end can be pointed in a direction that is at least ninety degrees from the direction in which said second end can be pointed.

3. Apparatus as in claim 1, wherein said connecting means includes:

a means for selectively attaching said rear end of said adaptor to said suction localizing means; and a means for selectively attaching said front end of said adaptor to said rear end of said fan housing.

4. Apparatus as in claim 1, wherein said temperature dependent opening and closing means includes:

at least two elongated louvers, each said louver defining a longitudinal axis of rotation, a means for linking said louvers for simultaneous rotation about each longitudinal axis of rotation of each said louver, and a bimetallic coil having a free end disposed outside said coil and engaging said drive element, said coil having an opposite free end disposed inside said coil.

5. Apparatus as in claim 1, wherein said means for selectively attaching said front end of said adaptor to said rear end of said fan housing includes an adhesive member connected to said front end of said adaptor and to said rear end of said fan housing.

6. Apparatus as in claim 1, wherein said adaptor includes at least two similarly configured members.

7. Apparatus as in claim 1, wherein said means for selectively attaching said front end of said adaptor to said rear end of said fan housing includes a hook substrate carried by a first of said similarly configured members and a loop substrate carried by a second of said similarly configured members and disposed to engage said hook substrate.

8. Apparatus as in claim 1, wherein said means for selectively attaching said rear end of said adaptor to said first end of said duct includes a second hook substrate carried by a first of said similarly configured members and a second loop substrate carried by a second of said similarly configured members and disposed to engage said second hook substrate.

9. An adaptable, temperature-responsive, powdered-fan foundation ventilator system, comprising:

a fan housing defining an air passageway therethrough, said fan housing defining a front edge and a rear end disposed generally opposite said front edge;

an electric-powdered fan mounted to said fan housing;

a means for localizing the suction capability of said fan;

a means for connecting said suction localizing means and said fan housing, said connecting means including an adaptor having a front end disposed to be connected to said rear end of said fan housing, said adaptor having a rear end disposed to be connected to said localizing means;

a louver housing defining an air passageway therethrough, said louver housing defining a front edge and a rear edge opposite said front edge, said rear edge of said louver housing being disposed in opposition to said front edge of said fan housing;

a means for selectively opening and closing said louver housing air passageway depending upon the temperature of the surrounding atmosphere, said temperature dependent opening and closing means being disposed in said air passageway of said louver housing, wherein said front end of adaptor is formed of flexible material, wherein said means for selectively attaching said front end of said adaptor to said rear end of said fan housing includes an elastic member connected to said front end of said adaptor.

* * * * *